US011849780B2

(12) United States Patent
McMullin

(10) Patent No.: US 11,849,780 B2
(45) Date of Patent: Dec. 26, 2023

(54) SAIL SHIRT

(71) Applicant: Eric William McMullin, Alhambra, CA (US)

(72) Inventor: Eric William McMullin, Alhambra, CA (US)

( * ) Notice: Subject to any disclaimer, the term of this patent is extended or adjusted under 35 U.S.C. 154(b) by 2 days.

(21) Appl. No.: 17/180,209

(22) Filed: Feb. 19, 2021

(65) Prior Publication Data

US 2022/0264959 A1 Aug. 25, 2022

(51) Int. Cl.
*A41D 1/04* (2006.01)
*A41D 13/02* (2006.01)
*A41D 13/012* (2006.01)

(52) U.S. Cl.
CPC ..... *A41D 13/02* (2013.01); *A41D 1/04* (2013.01); *A41D 13/012* (2013.01)

(58) Field of Classification Search
CPC ..... B64D 10/00; B64D 17/00
USPC ..... 244/143, 902, 4 A; 280/810
See application file for complete search history.

(56) References Cited

U.S. PATENT DOCUMENTS 1,693,464 A * 11/1928 Quantz ..... A41D 15/00 2/86
1,757,854 A * 5/1930 Castagne ..... B64D 10/00 244/143
4,220,299 A * 9/1980 Motter ..... B64D 17/00 2/84
5,010,589 A * 4/1991 Hamilton ..... A41D 15/00 D5/43
5,176,600 A * 1/1993 Wilkinson ..... A63B 21/4021 482/122
5,781,930 A * 7/1998 Boshoff ..... A41D 13/00 2/93
5,873,131 A 2/1999 Sabin
8,695,117 B1 * 4/2014 Machuca ..... A41D 31/18 2/69
2003/0222178 A1 * 12/2003 Chen ..... B64D 17/00 244/143

(Continued)

FOREIGN PATENT DOCUMENTS

CN 202464133 U 10/2012
CN 207 545 656 U 6/2018

(Continued)

OTHER PUBLICATIONS

International Search Report and Written Opinion issued in related PCT Application No. PCT/US2022/015783, dated May 20, 2022, 13 pages.

*Primary Examiner* — Katherine M Moran
*Assistant Examiner* — Grady Alexander Nunnery
(74) *Attorney, Agent, or Firm* — LEWIS ROCA ROTHGERBER CHRISTIE LLP

(57) ABSTRACT

A garment includes a torso portion adapted to cover a wearer's torso; a first sleeve extending from the torso portion at a proximal end of the first sleeve; a second sleeve extending from the torso portion at a proximal end of the second sleeve; a first flap spanning between the torso portion and the first sleeve; and a second flap spanning between the torso portion and the second sleeve. One or more openings along a side of the first flap adjacent to the torso portion and one or more openings along a side of the second flap adjacent to the torso portion are adapted to allow a personal flotation device vest to be secured to the garment.

22 Claims, 11 Drawing Sheets

(56) References Cited

U.S. PATENT DOCUMENTS

| | | | | |
|---|---|---|---|---|
| 2011/0056000 | A1* | 3/2011 | Gonzalez | A41B 13/005 2/243.1 |
| 2014/0182043 | A1 | 7/2014 | Moore | |
| 2019/0021408 | A1* | 1/2019 | Mangnall-Schwarz | A63J 7/00 |
| 2020/0039649 | A1* | 2/2020 | Gerdes | B64D 10/00 |

FOREIGN PATENT DOCUMENTS

| | | | |
|---|---|---|---|
| EP | 3 199 045 | A1 | 8/2017 |
| FR | 3026920 | A1 | 4/2016 |
| WO | WO 2011/002305 | A1 | 1/2011 |
| WO | WO 2018/053813 | A1 | 3/2018 |

* cited by examiner

SAIL SHIRT

BACKGROUND

1. Field

The present disclosure relates to a garment, and more particularly, to a garment to be worn while standup paddle boarding or while engaged in other sport, recreational, and physical activities.

2. Description of the Related Art

Standup paddle boarding is an activity where a person stands upright on a board and uses a paddle to move himself or herself along a body of water. Due to the developing interest in standup paddle boarding, there is a need to enhance the enjoyment and safety of persons engaged in this sport.

SUMMARY

According to an embodiment, a garment includes a torso portion adapted to cover a wearer's torso; a first sleeve extending from the torso portion at a proximal end of the first sleeve; a second sleeve extending from the torso portion at a proximal end of the second sleeve; a first flap spanning between the torso portion and the first sleeve; and a second flap spanning between the torso portion and the second sleeve. One or more openings along a side of the first flap adjacent to the torso portion and one or more openings along a side of the second flap adjacent to the torso portion are adapted to allow a personal flotation device vest to be secured to the garment.

According to another embodiment, a garment includes a torso portion adapted to cover a wearer's torso; a first sleeve extending from an upper region of the torso portion; a second sleeve extending from the upper region of the torso portion; a first flap spanning between the torso portion and the first sleeve; and a second flap spanning between the torso portion and the second sleeve. A plurality of loops around a lower region of the torso portion are adapted to allow a personal flotation device belt to be secured to the garment.

According to another embodiment, a garment includes a torso portion adapted to cover a wearer's torso; a first sleeve extending from the torso portion; a second sleeve extending from the torso portion; a first flap spanning between the torso portion and the first sleeve, the first flap being attached or adapted to attach to the first sleeve along a longitudinal direction of the first sleeve; and a second flap spanning between the torso portion and the second sleeve, the second flap being attached or adapted to attach to the second sleeve along a longitudinal direction of the second sleeve.

DESCRIPTION OF THE DRAWINGS

The present disclosure will be better understood with reference to the detailed description in conjunction with the attached drawings, in which.

DETAILED DESCRIPTION

Embodiments of the present disclosure will be described with respect to the drawings. However, the present disclosure is not limited by the descriptions and illustrations of the disclosed embodiments. For example, one of ordinary skill in the art will understand that elements, features, and aspects of one embodiment should generally be available for other embodiments, unless the context clearly indicates otherwise.

As used in this specification, the term "and/or" includes any and all combinations of one or more of the associated listed items. It will be understood that when an element or component is referred to as being "on," "coupled to," "connected to," or "attached to" another element or component, it can be directly on, coupled to, connected to, or attached to the other element or component, or one or more intervening elements or components may also be present. As used in this specification, the term "substantially," "about," "approximately," and similar terms are used as terms of approximation and not as terms of degree, and are intended to account for the inherent deviations in measured or calculated values that would be recognized by those of ordinary skill in the art.

Figure 1:
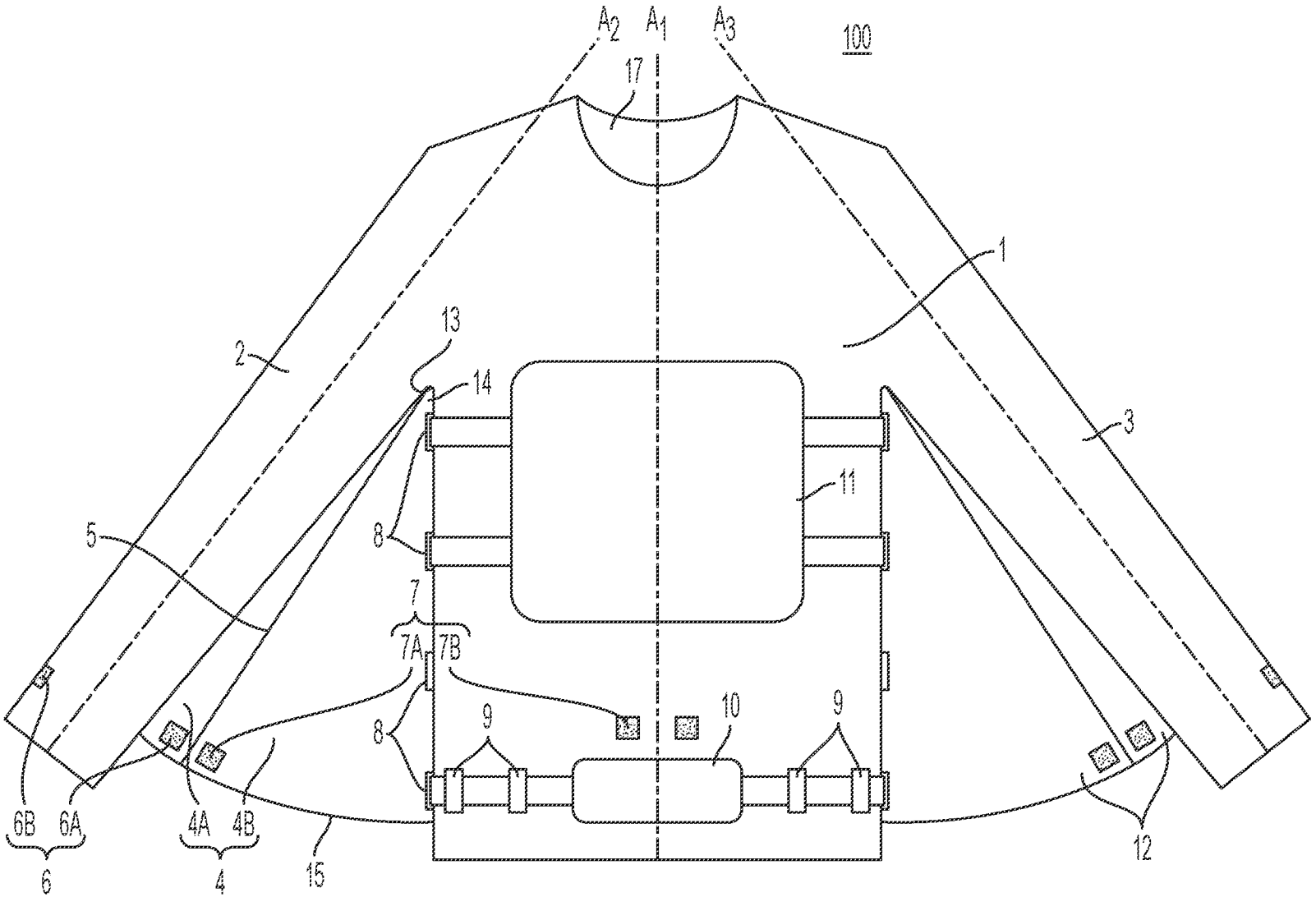
FIG. 1 illustrates a garment according to an embodiment of the present disclosure.

FIG. 1 illustrates a garment 100 with a body similar to a tee shirt or rash guard, but unlike a tee shirt or rash guard, includes wing-like flaps 4, 12. When a wearer of the garment is engaged in standup paddle boarding (SUP), the garment may provide various benefits and enhancements to the SUP experience. SUP is an activity where a person stands upright on a standup paddle board and uses a paddle to move around on a body of water such as the ocean, a bay, a lake, or a river. The wing-like flaps of the garment can act as sails so that the wearer can employ the wind to assist him or her in propelling the standup paddle board through the water. The garment 100 includes a torso portion 1, an upper neck-hole 17, a first sleeve 2 extending from one side of the torso portion 1 and generally adjacent the neck-hole 17, a second sleeve 3 extending from an opposite side of the torso portion 1 and also generally adjacent the neck-hole 17, a first flap 4 between the torso portion 1 and the first sleeve 2, and a second flap 12 between the torso portion 1 and the second sleeve 3.

The garment 100 is worn like a tee shirt or rash guard with the torso portion 1 generally covering the torso of the wearer with the wearer's head extending through the neck-hole 17 and the wearer's arms extending through the first and second sleeves 2 and 3.

In FIG. 1, the torso portion 1 defines a longitudinal axis A1.

In some embodiments, the garment 100 may include a plurality of loops 9 around a perimeter of the lower region of the torso portion 1. The plurality of loops 9 allow the wearer to secure a belt, for example, a personal flotation device (PFD) belt 10, to the garment 100 and/or to the wearer. The number of the plurality of loops 9 may be any suitable number, for example, eight loops.

Figure 9:
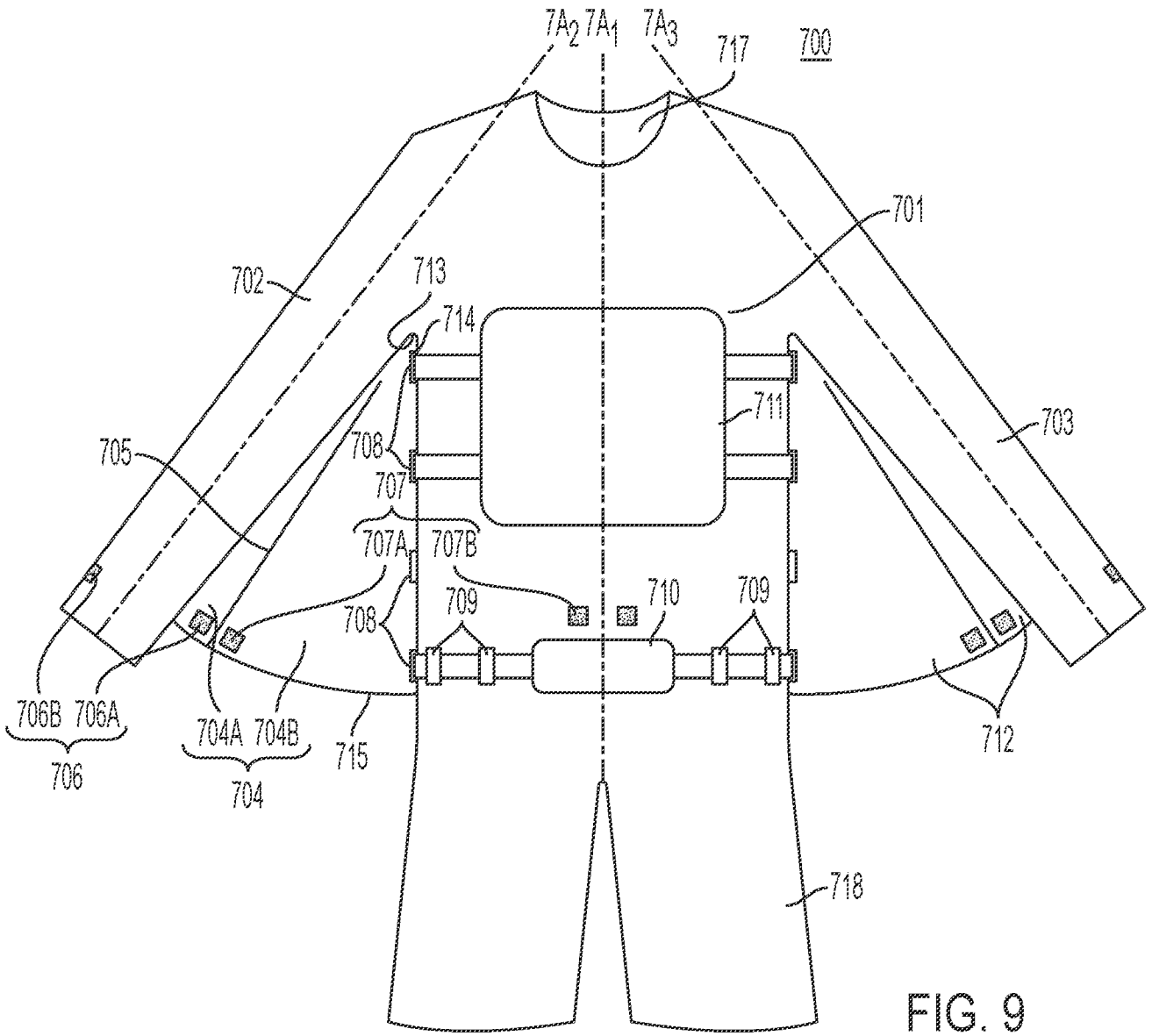
FIG. 9 illustrates a garment according to another embodiment of the present disclosure.

In some embodiments, the garment may further include a lower portion to allow the garment to be secured to the wearer's body so as to prevent the garment from riding up the wearer's torso while in use. For example, as shown in FIG. 9, a leg portion 718 is provided that extends from the lower region of the torso portion 701. The leg portion 718 may cover all or a portion of either or both legs of the wearer. In the embodiment of FIG. 9, the leg portion 718 includes first and second tubular legs intended to cover the wearer's thighs. For embodiments including leg portion 718, the garment 700 may further include a zipper or other fastener (not shown) as commonly included in wetsuits to more easily allow the garment 700 to be put on or removed.

Figure 10:
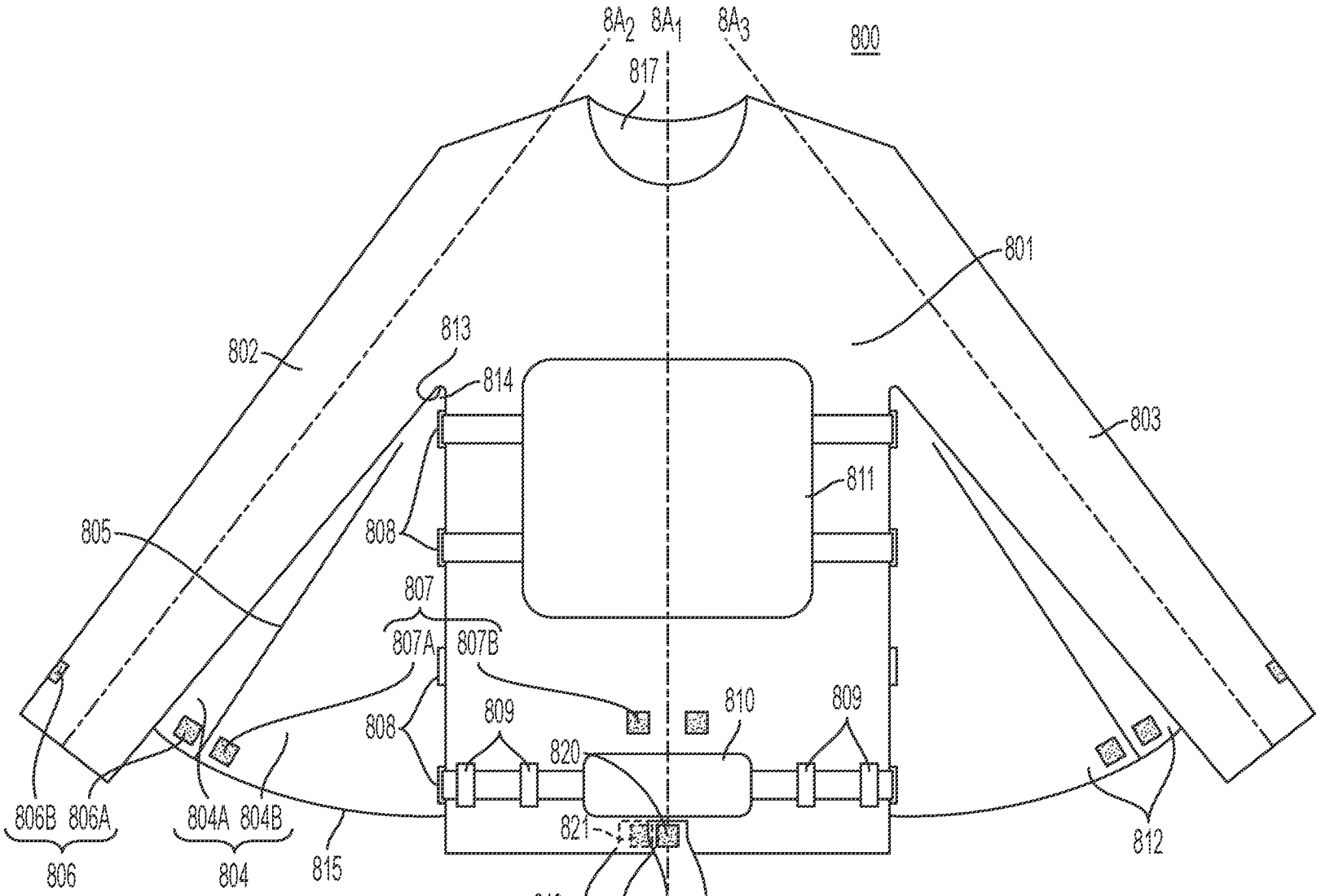
FIG. 10 illustrates a garment according to another embodiment of the present disclosure.

In another embodiment as shown in FIG. 10, a simple crotch strap 819 may be included to prevent the garment 800 from riding up the wearer's torso. The crotch strap 819 may be attached to the front and back of the torso portion 819 and may extend between the wearer's legs. A front connector 820 may be used to attach one end of the crotch strap 819 to the front of the torso portion 801, and a back connector 821 may be used to attach another end of the crotch strap 819 to the back of the torso portion 801. The front and back connectors 820 and 821 may each include, a hook-and-loop fastener, for example, a Velcro® brand hook-and-loop fastener, a button, a tether, a clip, for example, a buckle clip, or a magnet.

For convenience of description, for some elements and components, for example, sleeves, flaps, and connectors, only those elements and components on one side, for example, the wearer's right side, will be described. However, it will be understood that the description of these elements and components applies to the elements and components on the other side, for example, the wearer's left side, of the garment. For example, in some embodiments, the garment is reflectively symmetrical with respect to the longitudinal axis of the torso portion. However, the present disclosure is not limited thereto. For example, in some embodiments, the garment may not be reflectively symmetrical.

Referring to FIG. 1, the first sleeve 2 may extend from the torso portion 1 at a proximal end with a distal end opposite the proximal end. A portion of the garment 100 where the proximal end of the first sleeve 2 extends from the torso portion 1 may be a shoulder portion that is intended to cover a shoulder and/or an armpit of the wearer. An armpit portion 13 of the garment 100 may be a portion intended to cover an armpit of the wearer. The armpit portion 13 may be a sub-portion of the shoulder portion.

The first sleeve 2 may have any suitable length and may cover all or a portion of the wearer's arm. For example, the distal end of the first sleeve 2 may extend to the wearer's wrist or to any other point along the wearer's arm. In some embodiments, the first sleeve 2 may only cover the wearer's upper arm.

In FIG. 1, the first sleeve 2 defines a longitudinal axis A2, and the second sleeve 3 defines a longitudinal axis A3.

In some embodiments, the first sleeve 2 has a tubular shape that generally covers the wearer's arm along a length of the first sleeve 2.

The first flap 4 may be a piece of material spanning or extending between the torso portion 1 and the first sleeve 2. For example, the first flap 4 may include a flat or planar piece of material. In some embodiments, the first flap 4 may separate or detach at any suitable position. The wearer may want to separate or detach the wing-like flaps when he or she does not want to be propelled by the sail-like effect of the flaps, such as when the wearer is paddling into the wind, trying to turn the standup paddle board, when the wind is too strong to safely use the flaps, or when the direction of the wind is sporadic or unpredictable.

In some embodiments, the wing-like flaps are fixed rather than being separable or detachable. For example, in the embodiment of FIG. 11, the garment 900 includes a first flap 904 that is permanently attached to the torso portion 901 or from the first sleeve 902. Furthermore, the first flap 904 does not separate or divide anywhere between the torso portion 901 and the first sleeve 902.

Figure 5:
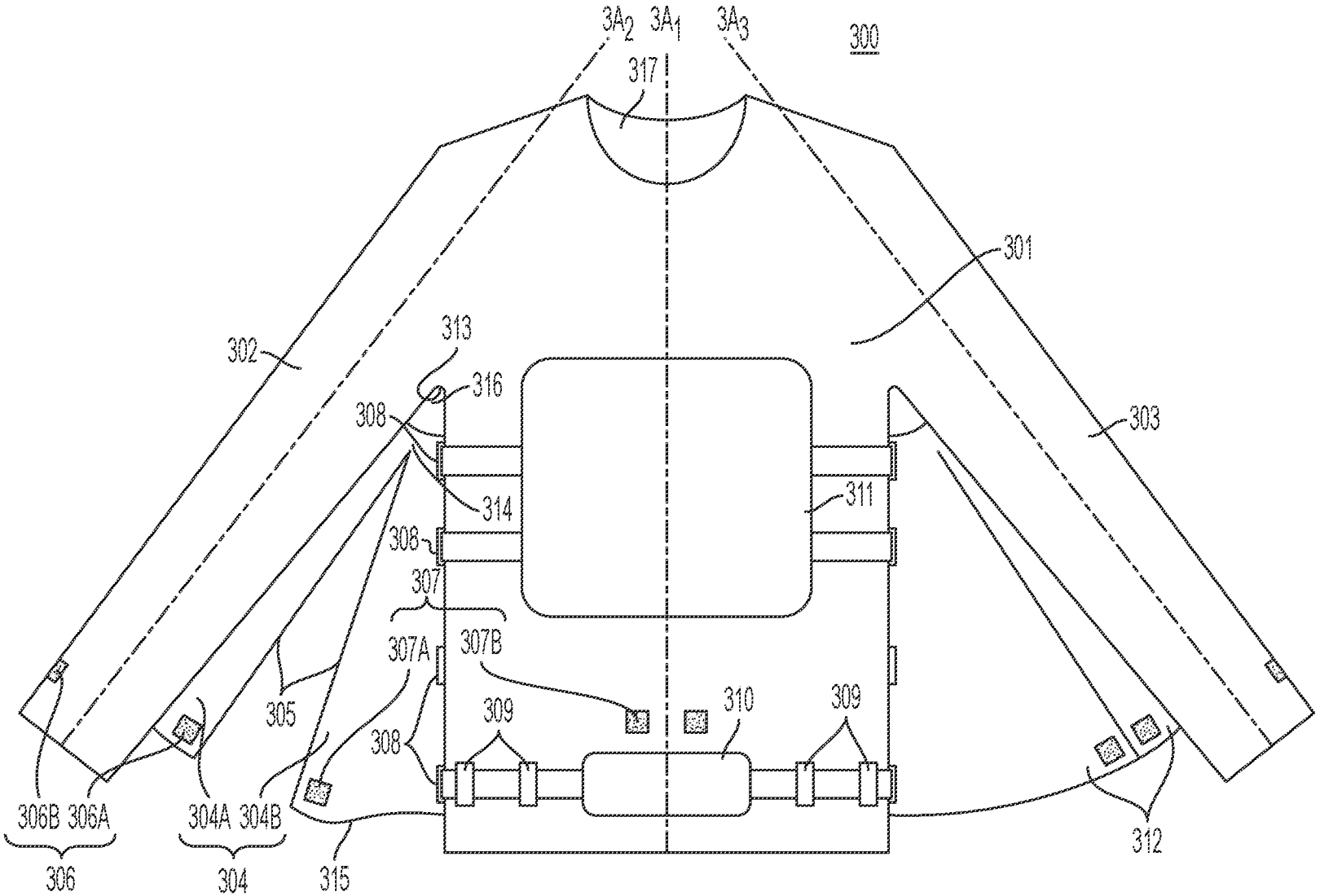
FIG. 5 illustrates a garment according to another embodiment of the present disclosure when the first flap is separated.

Referring to FIG. 1, the first flap 4 may have any suitable shape. For example, the first flap 4 may have a substantially triangular shape. The first flap 4 may have a corner 14 at a junction between the torso portion 1 and the first sleeve 2, for example, at the armpit portion 13 of the garment 100. For example, the corner 14 may be attached to the armpit portion 13. The first flap 4 may have an outer edge 15 opposite to the corner 14 that is not attached to the garment 100. The first flap 4 may extend along the first sleeve 2 in a direction from the proximal end of the first sleeve 2 toward the distal end of the first sleeve 2, and past an elbow portion of the first sleeve 2 that is configured to cover an elbow of the wearer. In some embodiments, as shown in the embodiment of FIG. 5, the corner 314 may be spaced apart from the armpit portion 313 by an opening 316.

Referring to FIG. 1, the first flap 4 may have any suitable size. For example, the first flap 4 may allow the wearer to extend his or her arms out to his or her sides by a maximum angle. The maximum angle may be measured at the junction between the first sleeve 2 and the torso portion 1. The maximum angle may be any suitable angle within the range of 0° and 180°. For example, the maximum angle may be any suitable angle within the range of 0° and 135°, within the range of 0° and 90°, within the range of 0° and 60°, or within the range of 0° and 45°.

In some embodiments, the first flap 4 includes a sleeve flap 4A and a torso flap 4B, and the first flap 4 separates between the sleeve flap 4A and the torso flap 4B. Each of the sleeve flap 4A and the torso flap 4B may have a substantially triangular shape having a corner at the junction between the torso portion 1 and the first sleeve 2, for example, at the armpit portion 13. The corners of the sleeve flap 4A and the torso flap 4B may form the corner 14 of the first flap 4. The description provided above for the corner 14 of the first flap 4 may also apply to each of the corner of the sleeve flap 4A and the corner of the torso flap 4B.

The sleeve flap 4A may have a first side fixed to the first sleeve 2 along a longitudinal direction of the first sleeve 2. The longitudinal direction of the first sleeve 2 may be a direction extending between the proximal and distal ends of the first sleeve 2, for example, a direction parallel to the longitudinal axis A2 of the first sleeve 2. The first side of the sleeve flap 4A may extend from the corner of the sleeve flap 4A toward the distal end of the first sleeve 2.

The torso flap 4B may have a first side fixed to the torso portion 1 along a longitudinal direction of the torso portion 1. The longitudinal direction of the torso portion 1 may be a direction extending between the upper region and the lower region of the torso portion 1, for example, a direction parallel to the longitudinal axis A1 of the torso portion 1. The first side of the torso flap 4B may extend from the corner of the torso flap 4B toward the lower region of the torso portion 1.

Figure 3:
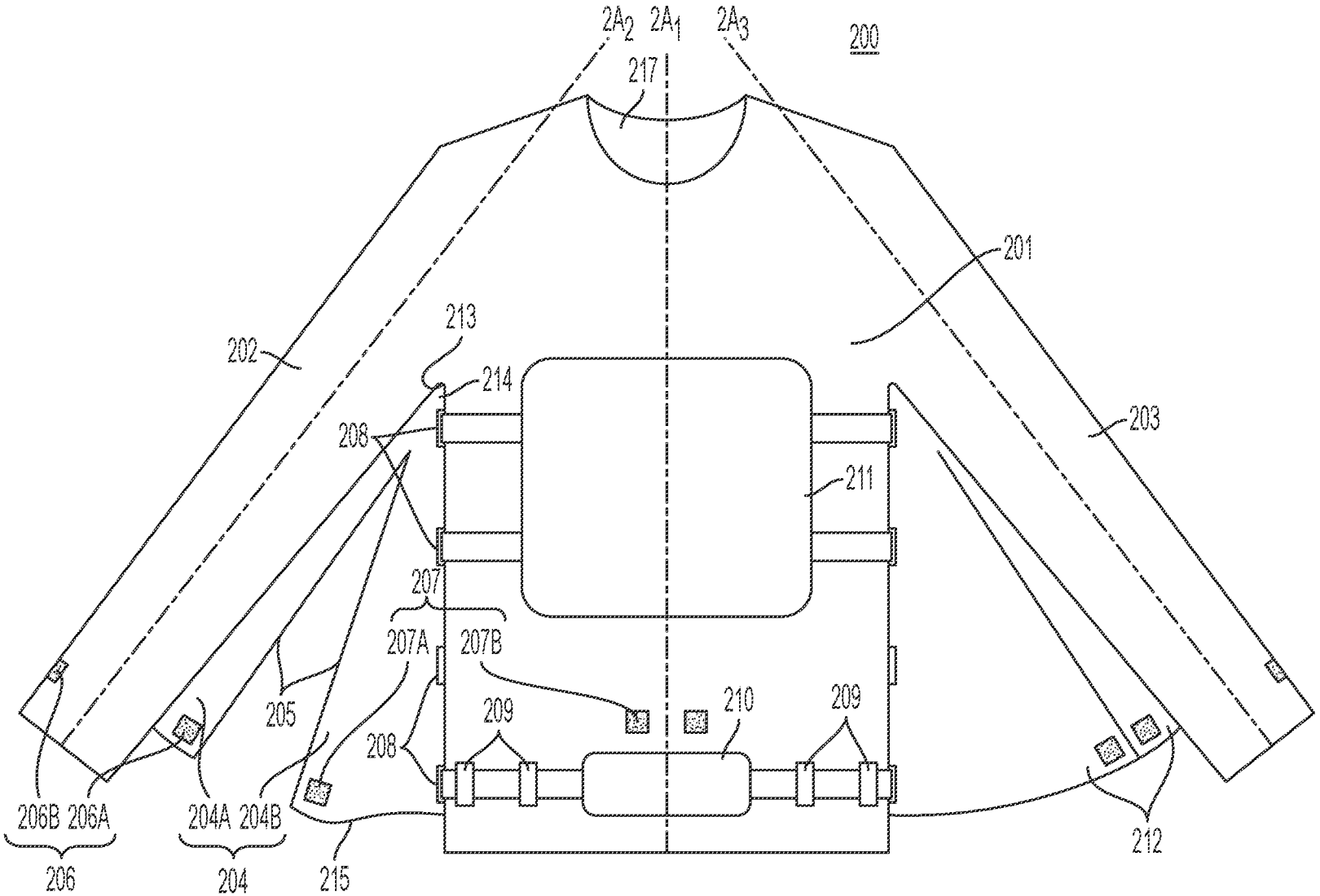
FIG. 3 illustrates a garment according to another embodiment of the present disclosure when the first flap is separated.
Figure 4:
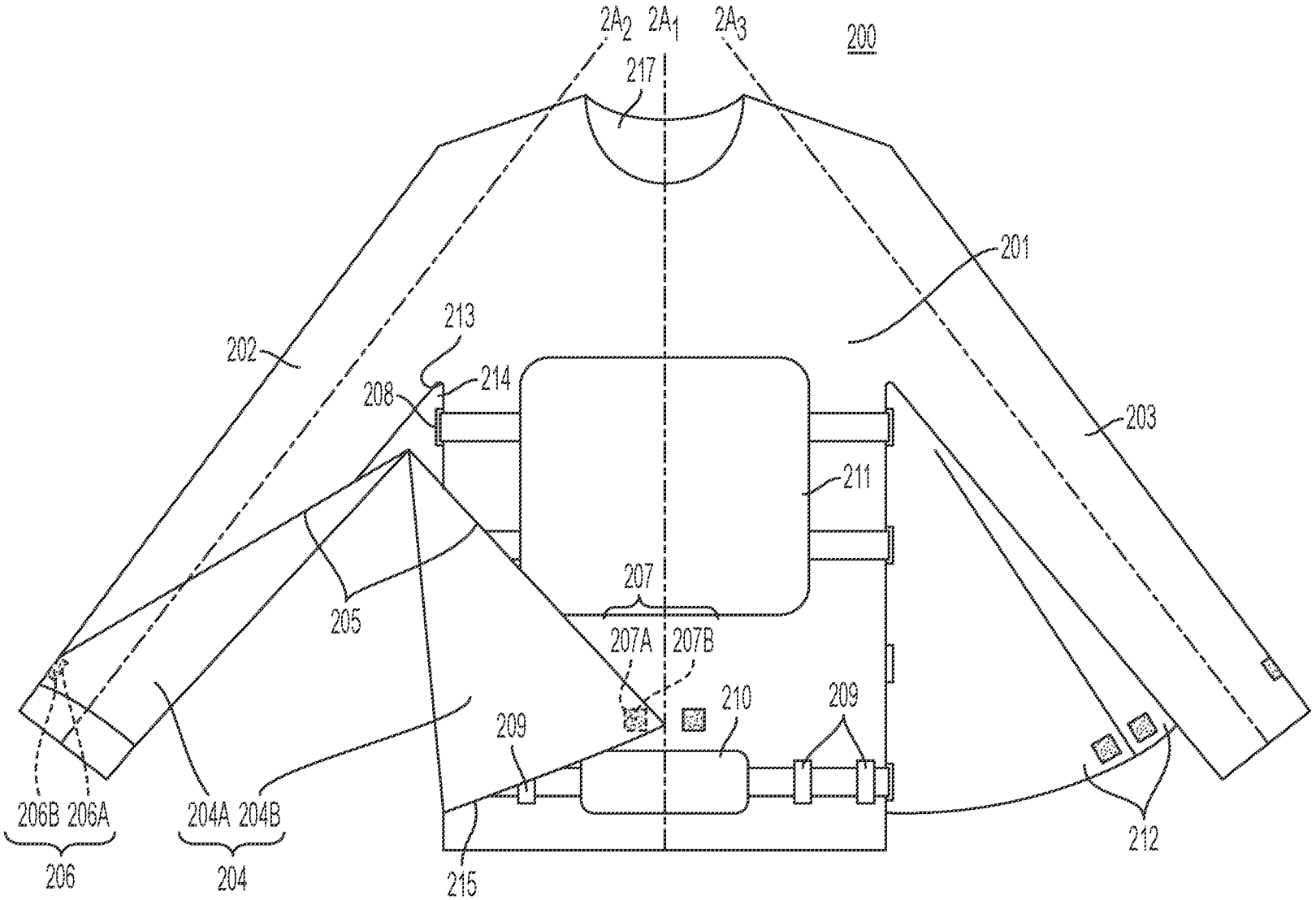
FIG. 4 illustrates the garment of FIG. 3 when the first flap is separated and when the sleeve and torso flaps of the first flap are respectively secured to the first sleeve and to the torso portion.

The sleeve flap 4A may have a second side, the torso flap 4B may have a second side, and the first flap 4 may separate between the second side of the sleeve flap 4A and the second side of the torso flap 4B. The second side of the sleeve flap 4A and the second side of the torso flap 4B may each extend from the outer edge 15 toward the corner 14. A length of the second side of the sleeve flap 4A may be equal to a length of the second side of the torso flap 4B. In some embodiments, as shown in the embodiments of FIGS. 3 and 4, the second sides of the sleeve flap 204A and the second side of the torso flap 204B do not extend to the corner 214, but rather extend to a portion of the first flap 204 where the sleeve flap 204A and the torso flap 204B are attached and do not separate.

Referring to FIG. 1, a first connector 5 may attach the sleeve flap 4A and the torso flap 4B together. For example, the first connector 5 may attach the second side of the sleeve flap 4A and the second side of the torso flap 4B together. The first connector 5 may include a zipper, a hook-and-loop fastener, for example, a Velcro® brand hook-and-loop fastener, a button, a tether, a clip, for example, a buckle clip, or a magnet. In some embodiments, the first connector 5 may be a zipper having a first half along the second side of the sleeve flap 4A and a second half along the second side of the torso flap 4B.

The garment 100 may include one or more openings 8 along the first side of the torso flap 4B. The openings along the sides of the torso portion may allow the wearer to secure a personal flotation device vest to the garment. The number of the openings 8 may be any suitable number, for example, four openings. The size and shape of each of the openings 8 may be any suitable size and shape. The perimeter of each of the openings 8 may be reinforced with a rigid material or semi-rigid material, or multiple layers of material may be used to prevent tears from occurring at or around the openings 8. For example, the openings 8 may be reinforced with a plastic and/or a metal. In some embodiments, the openings 8 may be provided between the torso portion 1 and the first side of the torso flap 4B. In some embodiments, the openings 8 may be in the torso flap 4B along the first side of the torso flap 4B. The openings 8 may allow a vest, for example, a PFD vest 11, to be secured to the garment and/or to the wearer.

In some embodiments, the torso flap 4B, for example, the first side of the torso flap 4B, may extend between two loops from among the plurality of loops 9, and one of the openings 8 may, together with the plurality of loops 9, allow the PFD belt 10 to be secured to the garment 100 and/or to the wearer. For example, one opening from among the openings 8 may be positioned between two loops from among the plurality of loops 9 to allow the PFD belt 10 to be fitted through the two loops from among the plurality of loops 9 and through the one opening from among the openings 8.

In some embodiments, the first side of the torso flap 4B may not extend between the two loops from among the plurality of loops 9. For example, the outer edge 15 may be higher along the torso portion 1 than the plurality of loops 9 at a point where the outer edge 15 meets the torso portion 1.

The garment 100 may include a second connector 6 to secure the sleeve flap 4A to and/or around the first sleeve 2. The second connector 6 may allow the wearer to prevent the sleeve flap 4A from flailing around in the wind or otherwise interfering with the wearer's movements when the first flap 4 is separated. The second connector 6 may include a zipper, a hook-and-loop fastener, a button, a tether, a clip, for example, a buckle clip, or a magnet. In some embodiments, the second connector 6 is a hook-and-loop fastener.

The second connector 6 may include a first half 6A and a second half 6B that can be attached together. The first half 6A may be at any suitable position on the sleeve flap 4A. In some embodiments, the first half 6A may be on a front side of the sleeve flap 4A at a junction between the second side of the sleeve flap 4A and the outer edge 15.

The second half 6B of the second connector 6 may be at any suitable position on the first sleeve 2 or on the sleeve flap 4. In some embodiments, the second half 6B may be at or near the distal end of the first sleeve 2 such that, when the first flap 4 is separated and the first sleeve 2 is wrapped around the longitudinal axis A2 of the first sleeve 2, the first half 6A and the second half 6B meet and attach together to secure the sleeve flap 4A to and/or around the first sleeve 2. In some embodiments, the second half 6B may be at any suitable position on the back side of the sleeve flap 4A opposite to the front side of the sleeve flap 4A such that, when the first flap 4 is separated and the sleeve flap 4A is wrapped around the longitudinal axis A2 of the first sleeve 2, the first half 6A and the second half 6B meet and attach together to secure the sleeve flap 4A to and/or around the first sleeve 2.

The garment 100 may include a third connector 7 that allows the torso flap 4B to be secured to and/or around the torso portion 1. The third connector 7 may allow the wearer to prevent the torso flap 4B from flailing around in the wind or otherwise interfering with the wearer's movements when the first flap 4 is separated. The third connector 7 may include a zipper, a hook-and-loop fastener, a button, a tether, a clip, for example, a buckle clip, or a magnet. In some embodiments, the third connector 7 is a hook-and-loop fastener.

The third connector 7 may include a first half 7A and a second half 7B that can be attached together. The first half 7A may be at any suitable position on the torso flap 4B. In some embodiments, the first half 7A may be on a front side of the torso flap 4B at a junction between the second side of the torso flap 4B and the outer edge 15.

The second half 7B of the third connector 7 may be at any suitable position on the torso portion 1 such that, when the first flap 4 is separated and the torso flap 4B is wrapped around the longitudinal axis A1 of the torso portion 1, the first half 7A and the second half 7B meet and are attached together to secure the torso flap 4B to and/or around the torso portion 1.

Figure 2:
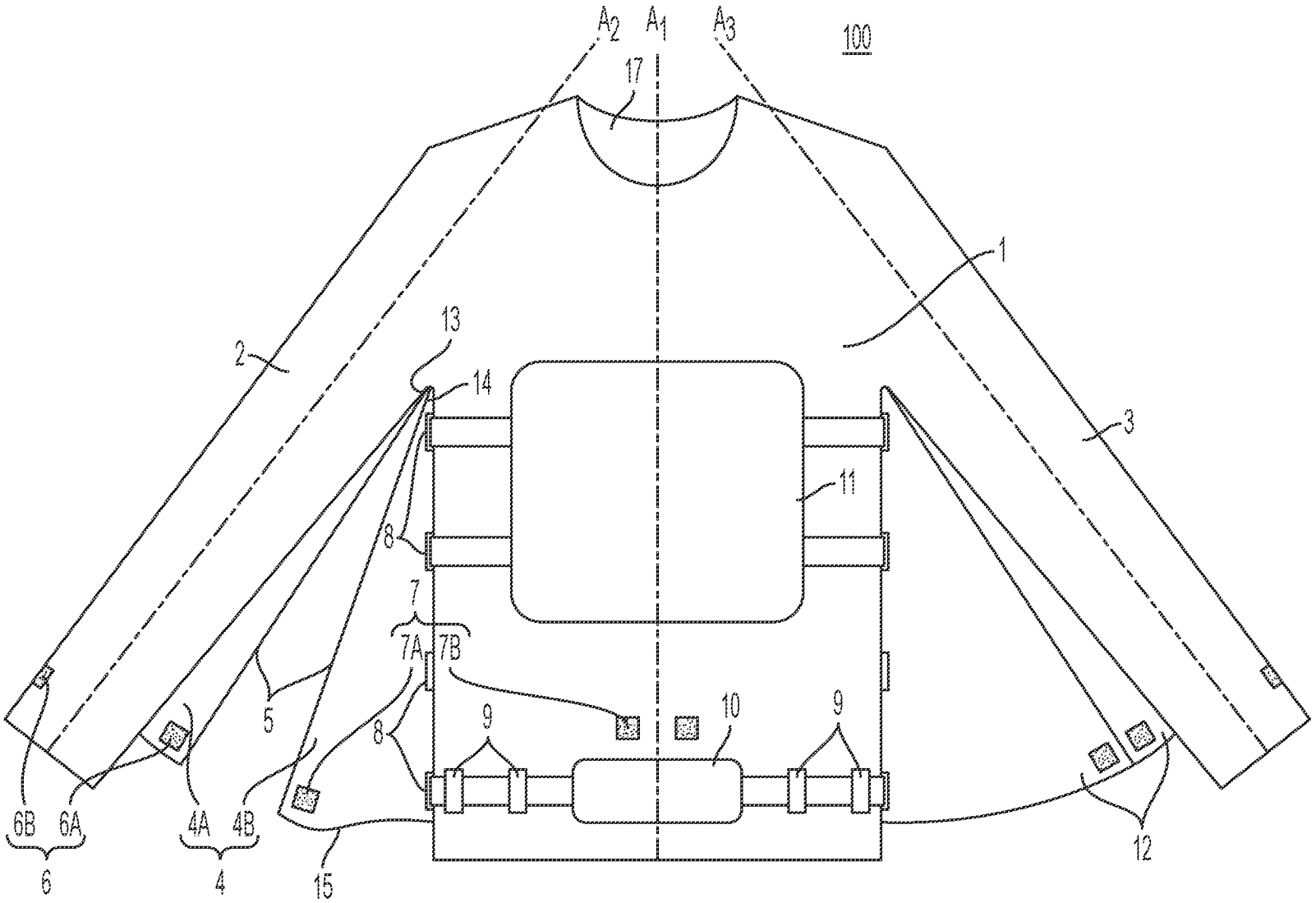
FIG. 2 illustrates the garment of FIG. 1 when the first flap is separated.

FIG. 2 illustrated the garment 100 of FIG. 1 when the first flap 4 is separated. FIG. 3 illustrates a garment 200 according to another embodiment of the present disclosure when the first flap 204 is separated. FIG. 4 illustrates the garment 200 of FIG. 3 when the first flap 204 is separated, the sleeve flap 204A is secured to the first sleeve 202 via the second connector 206, and the torso flap 204B is secured to the torso portion 201 via the third connector 207. Referring to FIGS. 3 and 4, the garment 200 includes the torso portion 201 defining the longitudinal axis 2A1; the first sleeve 202 defining the longitudinal axis 2A2; the second sleeve 203 defining the longitudinal axis 2A3; the first flap 204 including the sleeve flap 204A, the torso flap 204B, the corner 214, and the outer edge 215; the second flap 212; the armpit portion 213; the neck-hole 217; the one or more openings 208; the plurality of loops 209; the first connector 205; the second connector 206 including the first half 206A and the second half 206B; and the third connector 207 including the first half 207A and the second half 207B. FIGS. 3 and 4 also illustrate the PDF belt 210 secured to the garment 200 and the PDF vest 211 secured to the garment 200.

Referring to FIG. 5, the garment 300 includes the torso portion 301 defining the longitudinal axis 3A1; the first sleeve 302 defining the longitudinal axis 3A2; the second sleeve 303 defining the longitudinal axis 3A3; the first flap 304 including the sleeve flap 304A, the torso flap 304B, the corner 314, and the outer edge 315; the second flap 312; the armpit portion 313; the opening 316; the neck-hole 317; the one or more openings 308; the plurality of loops 309; the first connector 305; the second connector 306 including the first half 306A and the second half 306B; and the third connector 307 including the first half 307A and the second half 307B. FIG. 5 also illustrates the PDF belt 310 secured to the garment 300 and the PDF vest 311 secured to the garment 300.

Figure 6:
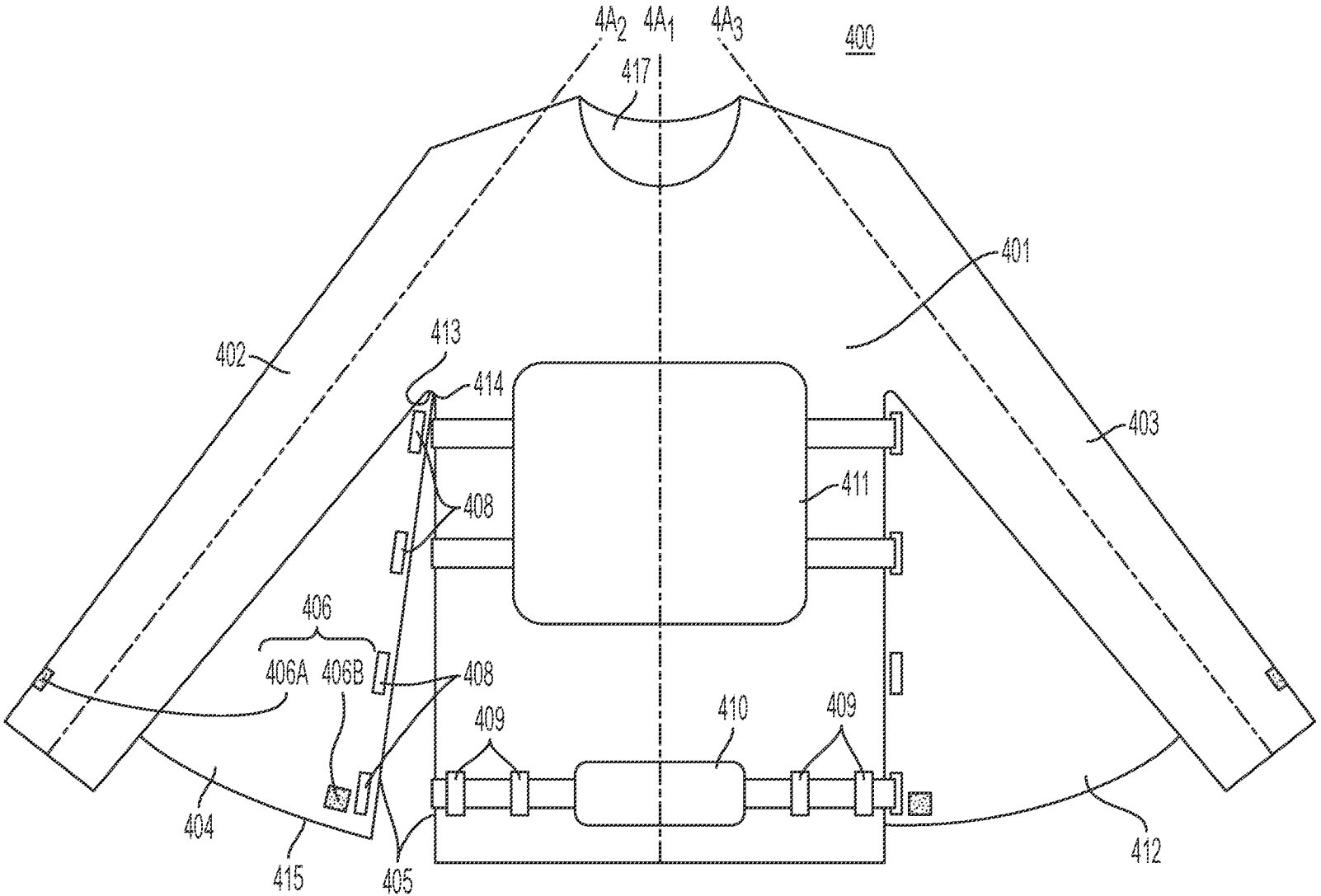
FIG. 6 illustrates a garment according to another embodiment of the present disclosure when the first flap is separated from the torso portion.

In some embodiments, the first flap may fully separate from the torso portion and/or from the first sleeve. For example, FIG. 6 illustrates an embodiment where the first flap 404 may fully separate from the torso portion 401. The first flap 404 may have a first side that separates from the torso portion 401 and a second side that is fixed to the first sleeve 402. In some embodiments, the first flap 404 does not separate between two pieces of the first flap 404, for example, between a sleeve flap and a torso flap. However, the present disclosure is not limited thereto. A first connector 405 may be used to attach the first side of the first flap 404 to the torso portion 401 in the same manner that the first connector 5 illustrated in, and described with respect to, FIG. 1 may be used to attach the second side of the sleeve flap 4A and the second side of the torso flap 4B together. Referring to the embodiment illustrated in FIG. 6, a second connector 406 may allow the first flap 404 to be secured to and/or around the first sleeve 402 in the same manner as the second connector 6 illustrated in, and described with respect to, FIG. 1 allows the sleeve flap 4A to be secured to the first sleeve 2. Referring to FIG. 6, the garment 400 includes the torso portion 401 defining the longitudinal axis 4A1; the first sleeve 402 defining the longitudinal axis 4A2; the second sleeve 403 defining the longitudinal axis 4A3; the first flap 404 including the corner 414 and the outer edge 415; the second flap 412; the armpit portion 413; the neck-hole 417; the one or more openings 408; the plurality of loops 409; the first connector 405; and the second connector 406 including the first half 406A and the second half 406B. FIG. 6 also illustrate the PDF belt 410 secured to the garment 400 and the PDF vest 411 secured to the garment 400.

Figure 7:
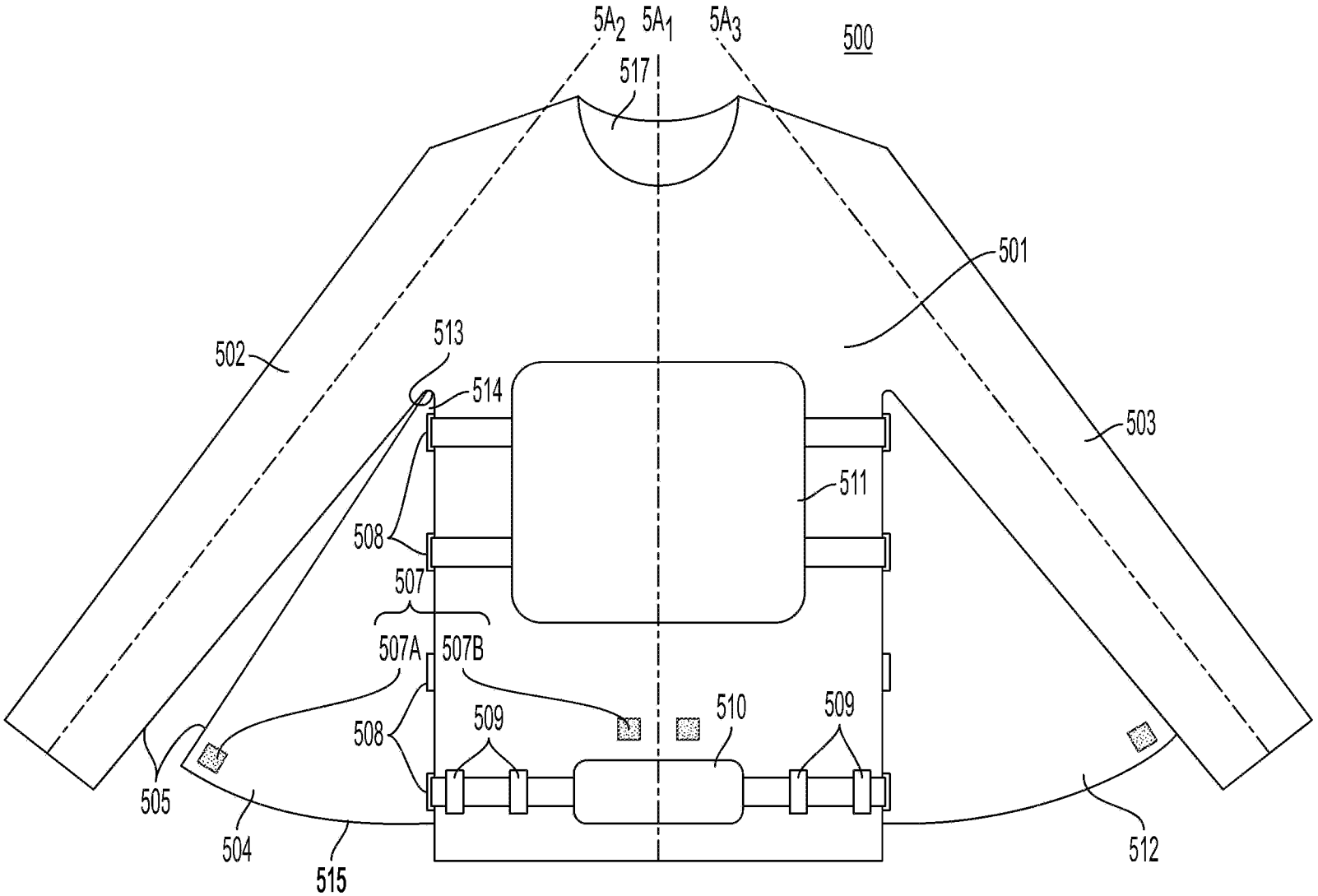
FIG. 7 illustrates a garment according to another embodiment of the present disclosure when the first flap is separated from the first sleeve.

FIG. 7 illustrates an embodiment where the first flap 504 may separate from the first sleeve 502. The first flap 504 may have a first side fixed to the torso portion 501 and a second side that separates from the first sleeve 502. In some embodiments, the first flap 504 does not separate between two pieces of the first flap 504, for example, between a sleeve flap and a torso flap. However, the present disclosure is not limited thereto. A first connector 505 may be used to attach the second side of the first flap 504 to the first sleeve 502 in the same manner as the first connector 5 illustrated in, and described with respect to, FIG. 1 may attach the second side of the sleeve flap 4A and the second side of the torso flap 4B together. Referring to FIG. 7, a third connector 507 may allow the first flap 504 to be secured to and/or around the torso portion 501 in the same manner as the third connector 7 illustrated in, and described with respect to, FIG. 1 allows the torso flap 4B to be secured to and/or around the torso portion 1. Referring to FIG. 7, the garment 500 includes the torso portion 501 defining the longitudinal axis 5A1; the first sleeve 502 defining the longitudinal axis 5A2; the second sleeve 503 defining the longitudinal axis 5A3; the first flap 504 including the corner 514 and the outer edge 515; the second flap 512; the armpit portion 513; the neck-hole 517; the one or more openings 508; the plurality of loops 509; the first connector 505; and the second connector 506 including the first half 506A and the second half 506B. FIG. 7 also illustrate the PDF belt 510 secured to the garment 500 and the PDF vest 511 secured to the garment 500.

Figure 8:
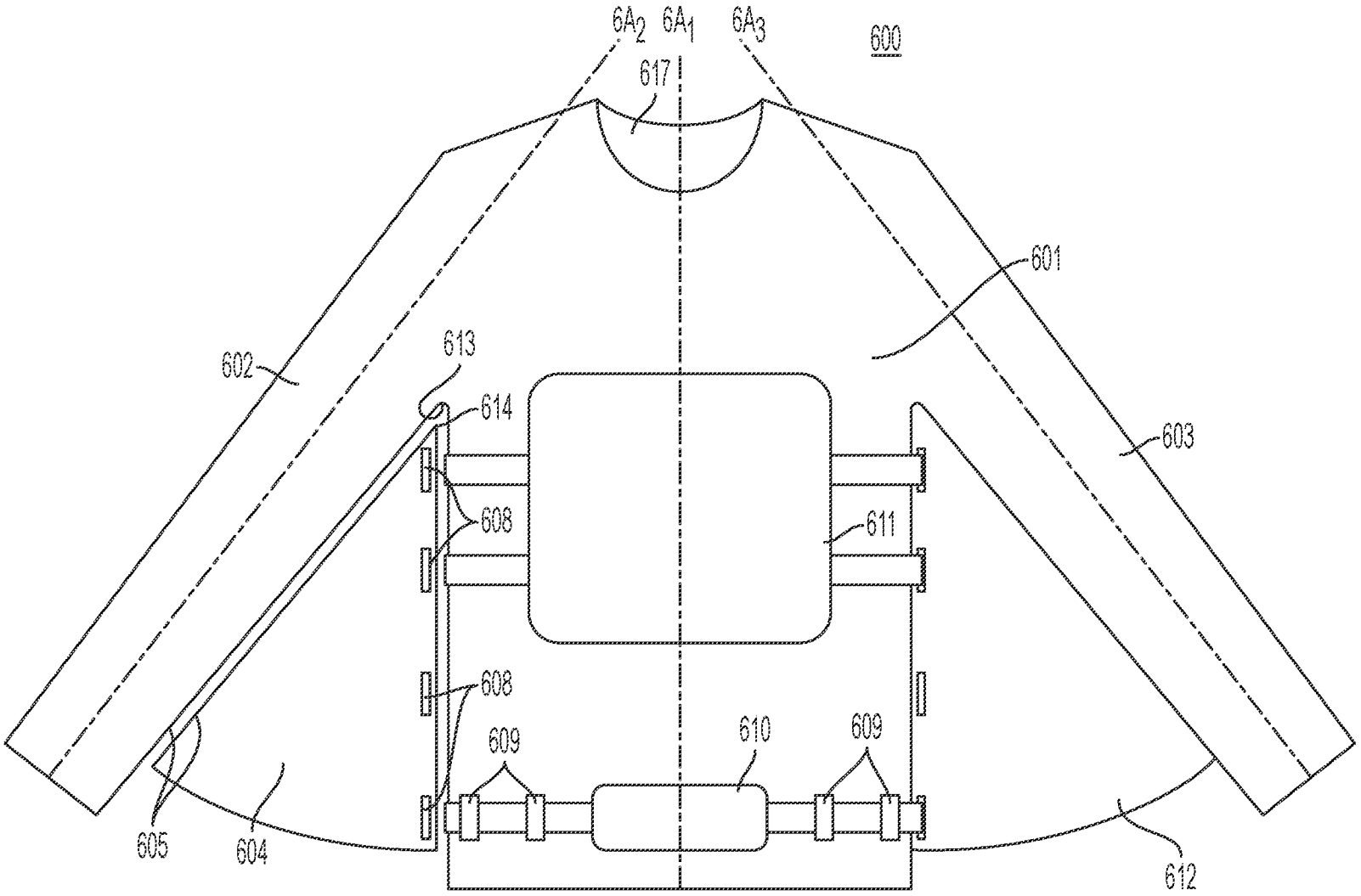
FIG. 8 illustrates a garment according to another embodiment of the present disclosure when the first flap is entirely separated from the rest of the garment.

FIG. 8 illustrates an embodiment where the first flap 604 may entirely separate from the rest of the garment. A first connector 605 may be used to attach the first flap 604 to the garment 600. The wearer may want to completely detach the flaps from the garment when the wearer does not want to use the flaps. Completely detaching the flaps may lighten the garment and increase the wearer's movability. Referring to FIG. 8, the garment 600 includes the torso portion 601 defining the longitudinal axis 6A1; the first sleeve 602 defining the longitudinal axis 6A2; the second sleeve 603 defining the longitudinal axis 6A3; the first flap 604 including the corner 614 and the outer edge 615; the second flap 612; the armpit portion 613; the neck-hole 617; the one or more openings 608; and the plurality of loops 609. FIG. 8 also illustrate the PDF belt 610 secured to the garment 600 and the PDF vest 611 secured to the garment 600.

Referring to FIG. 9, the garment 700 includes the torso portion 701 defining the longitudinal axis 7A1; the first sleeve 702 defining the longitudinal axis 7A2; the second sleeve 703 defining the longitudinal axis 7A3; the first flap 704 including the sleeve flap 704A, the torso flap 704B, the corner 714, and the outer edge 715; the second flap 712; the armpit portion 713; the neck-hole 717; the one or more openings 708; the plurality of loops 709; the first connector 705; the second connector 706 including the first half 706A and the second half 706B; and the third connector 707 including the first half 707A and the second half 707B. FIG. 9 also illustrate the PDF belt 710 secured to the garment 700 and the PDF vest 711 secured to the garment 700.

Referring to FIG. 10, the garment 800 includes the torso portion 801 defining the longitudinal axis 8A1; the first sleeve 802 defining the longitudinal axis 8A2; the second sleeve 803 defining the longitudinal axis 8A3; the first flap 804 including the sleeve flap 804A, the torso flap 804B, the corner 814, and the outer edge 815; the second flap 812; the armpit portion 813; the neck-hole 817; the one or more openings 808; the plurality of loops 809; the first connector 805; the second connector 806 including the first half 806A and the second half 806B; and the third connector 807 including the first half 807A and the second half 807B. FIG. 10 also illustrate the PDF belt 810 secured to the garment 800 and the PDF vest 811 secured to the garment 800.

Figure 11:
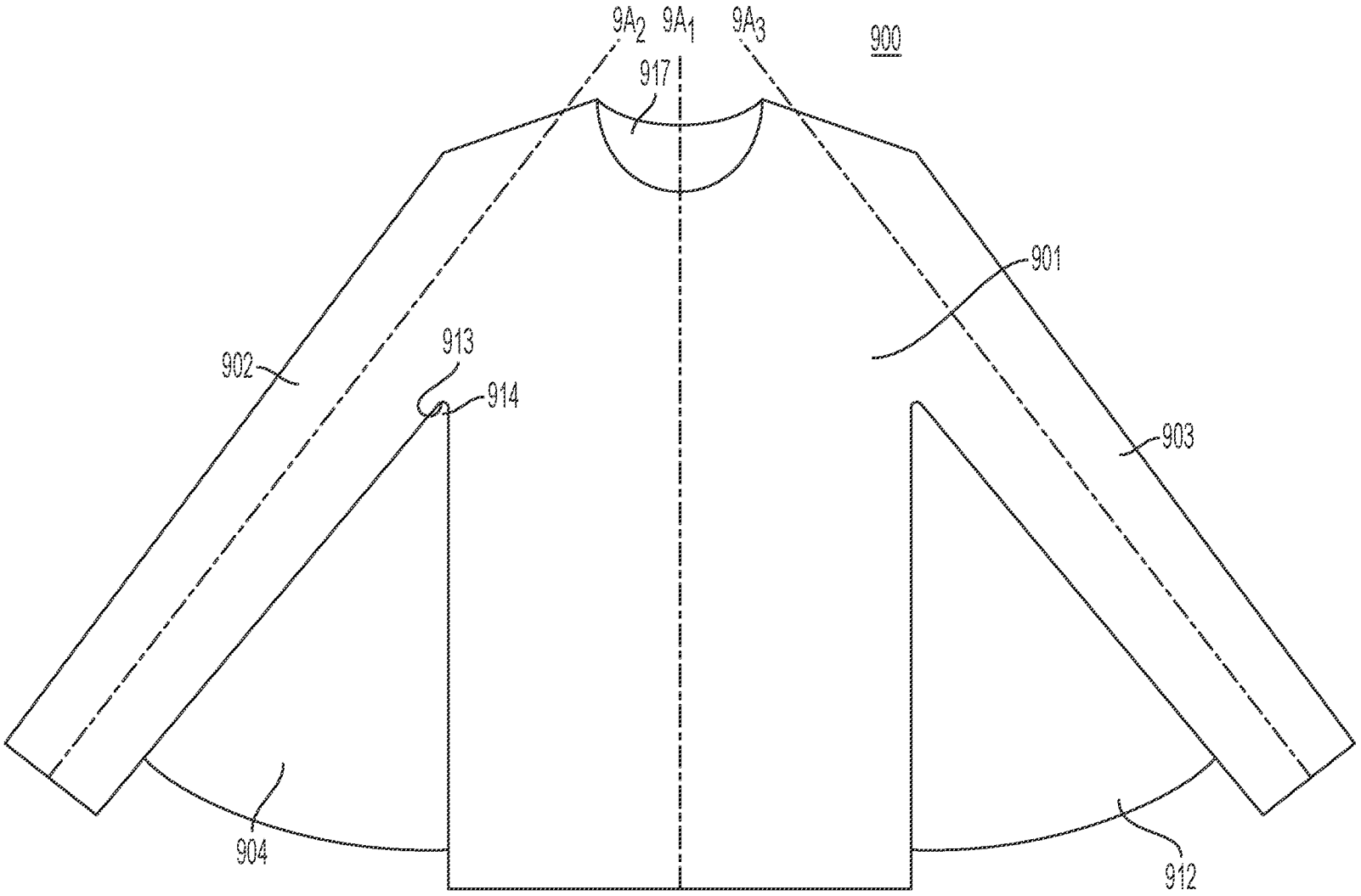
FIG. 11 illustrates a garment according to another embodiment of the present disclosure.

Referring to FIG. 11, the garment 900 includes the torso portion 901 defining the longitudinal axis 9A1; the first sleeve 902 defining the longitudinal axis 9A2; the second sleeve 903 defining the longitudinal axis 9A3; the first flap 904 including the corner 914; the second flap 912; the armpit portion 913; and the neck-hole 917.

The material of the garment may include any suitable fabric as is commonly used in garments intended for watersports. For example, the material of the garment may include a fabric such as nylon or polyester. In some embodiments, the material of the garment may include spandex. For comfort, it is generally preferred that the material be of a fabric with some amount of stretch. The material of the garment may be uniform or non-uniform throughout the garment. For example, referring to FIG. 1, the torso portion 1 and the first and second sleeves 2 and 3 may include a first material, and the first and second flaps 4 and 12 may include a second material different from the first material. If the garment 100 is to be worn in cold weather, the torso portion 1 may be made of neoprene or other materials commonly used in wetsuits or dry suits as are used in other watersports.

Although the garment has generally been described as similar to a tee shirt garment or rash guard, one of ordinary skill in the art will understand and appreciate that elements, features, and aspects of the garment described in this specification may be applied to other kinds of garments intended to be used for other sport and recreational activities.

Furthermore, although the garment has generally been described as being worn by someone engaged in standup paddle boarding, one of ordinary skill in the art will understand and appreciate that the garment may be worn by users while engaged in other sports or activities. For example, the garment may be worn in other paddling sports including kayaking, and could be particularly useful when used in connection with a surf-ski style of kayak.

While the subject matter of the present disclosure has been described in connection with the disclosed embodiments, it is to be understood that the subject matter of the present disclosure is not limited to the disclosed embodiments. Rather, the present disclosure is intended to cover various suitable modifications and equivalent arrangements included within the spirit and scope of the appended claims, and equivalents thereof.

The invention claimed is:

1. A garment comprising:

a torso portion adapted to cover a wearer's torso;

a first sleeve extending from the torso portion;

a second sleeve extending from the torso portion;

a first flap spanning between the torso portion and the first sleeve such that the first flap is configured to act as a sail, being permanently attached to the first sleeve along a longitudinal direction of the first sleeve, and fixedly attached or adapted to attach to, and extending along the torso portion in a direction from where the first sleeve extends from the torso portion toward a lower end of the torso portion without extending past the lower end of the torso portion; and a second flap spanning between the torso portion and the second sleeve such that the second flap is configured to act as a sail, being permanently attached to the second sleeve along a longitudinal direction of the second sleeve, and fixedly attached or adapted to attach to, and extending along the torso portion in a direction from where the second sleeve extends from the torso portion toward the lower end of the torso portion without extending past the lower end of the torso portion, wherein:

the first flap is adapted to separate from the torso portion, or the first flap defines a corner at a junction between the torso portion and the first sleeve and an outer edge opposite to the corner, and the first flap is adapted to separate along a line extending from the outer edge toward the corner, and wherein an end of the garment is defined at the lower end of the torso portion.

2. The garment of claim 1, wherein the torso portion is adapted to entirely cover the wearer's torso along a length of the torso portion, and wherein the first sleeve is adapted to entirely cover an arm of the wearer along a length of the first sleeve.

3. The garment of claim 1, wherein the first flap is fixedly attached to the torso portion along a longitudinal direction of the torso portion, and the second flap is fixedly attached to the torso portion along the longitudinal direction of the torso portion.

4. The garment of claim 1, further comprising a plurality of loops around a lower region of the torso portion and adapted to allow a personal flotation device belt to be coupled to the garment.

5. The garment of claim 4, wherein a side of the first flap is fixedly attached or adapted to attach to the torso portion along a longitudinal direction of the torso portion and between two loops from among the plurality of loops, and a side of the second flap is fixedly attached or adapted to attach to the torso portion along the longitudinal direction of the torso portion and between another two loops from among the plurality of loops, and wherein the plurality of loops, together with an opening along the side of the first flap between the two loops and an opening along the side of the second flap between the other two loops, are adapted to allow the personal flotation device belt to be coupled to the garment.

6. The garment of claim 1, wherein the first flap is adapted to separate from the torso portion.

7. The garment of claim 1, wherein the first flap defines a corner at a junction between the torso portion and the first sleeve and an outer edge opposite to the corner, and the first flap is adapted to separate along a line extending from the outer edge toward the corner.

8. The garment of claim 1, wherein the first flap comprises:

a sleeve flap having a first side and a second side, the first side being attached to the first sleeve along the longitudinal direction of the first sleeve; and a torso flap having a first side and a second side, the first side being attached to the torso portion along a longitudinal direction of the torso portion; and wherein the first flap is adapted to separate between the second side of the sleeve flap and the second side of the torso flap.

9. The garment of claim 8, wherein the torso flap is larger in area than the sleeve flap.

10. The garment of claim 8, further comprising a first connector adapted to attach together the second side of the sleeve flap and the second side of the torso flap, and the first connector comprises at least one selected from a zipper, a hook-and-loop fastener, a button, a clip, a tether, and a magnet.

11. The garment of claim 8, further comprising a second connector adapted to allow the sleeve flap to be secured to the first sleeve when the first flap is in a separated state and the sleeve flap is wrapped around a longitudinal axis of the first sleeve.

12. The garment of claim 11, wherein the second connector comprises a hook-and-loop fastener comprising a first half on the sleeve flap and a second half on the first sleeve.

13. The garment of claim 8, further comprising a third connector adapted to allow the torso flap to be secured to the torso portion when the first flap is in a separated state and the torso flap is wrapped around a longitudinal axis of the torso portion.

14. The garment of claim 13, wherein the third connector comprises a hook-and-loop fastener comprising a first half on the torso flap and a second half on the torso portion.

15. The garment of claim 1, wherein one or more openings along a first side of the first flap fixedly attached or adapted to attach to the torso portion and one or more openings along a first side of the second flap fixedly attached or adapted to attach to the torso portion are adapted to allow a personal flotation device to be coupled to the garment.

16. The garment of claim 15, further comprising a plurality of loops around a lower region of the torso portion and adapted to allow a personal flotation device belt to be coupled to the garment.

17. The garment of claim 16, wherein a first side of the first flap extends along a longitudinal direction of the torso portion and only part way across the lower region of the torso portion and between respective two loops from among the plurality of loops, and wherein the plurality of loops, together with an opening along the first side of the first flap and an opening along the first side of the second flap, allow the personal flotation device belt to be coupled to the garment.

18. The garment of claim 1, wherein the first flap defines a corner at a junction between the torso portion and the first sleeve, and an angle of two sides of the first flap form an angle equal to or less than 90 degrees at the corner.

19. The garment of claim 1, wherein the garment comprises a material selected from nylon, polyester, and combinations thereof.

20. A garment comprising:

a torso portion adapted to cover a wearer's torso;

a first sleeve extending from the torso portion;

a second sleeve extending from the torso portion;

a first flap spanning between the torso portion and the first sleeve such that the first flap is configured to act as a sail, being permanently attached to the first sleeve along a longitudinal direction of the first sleeve, and permanently attached to, and extending along the torso portion in a direction from where the first sleeve extends from the torso portion toward a lower end of the torso portion without extending past the lower end of the torso portion; and a second flap spanning between the torso portion and the second sleeve such that the second flap is configured to act as a sail, being permanently attached to the second sleeve along a longitudinal direction of the second sleeve, and permanently attached to, and extending along the torso portion in a direction from where the second sleeve extends from the torso portion toward the lower end of the torso portion without extending past the lower end of the torso portion, wherein:

the first flap defines a corner at a junction between the torso portion and the first sleeve and an outer edge opposite to the corner, and the first flap is adapted to separate along a line extending from the outer edge toward the corner.

21. A garment comprising:

a torso portion adapted to cover a wearer's torso;

a first sleeve extending from the torso portion;

a second sleeve extending from the torso portion;

a first flap spanning between the torso portion and the first sleeve such that the first flap is configured to act as a sail, being permanently attached to the first sleeve along a longitudinal direction of the first sleeve, and fixedly attached or adapted to attach to, and extending along the torso portion in a direction from where the first sleeve extends from the torso portion toward a lower end of the torso portion without extending past the lower end of the torso portion; and a second flap spanning between the torso portion and the second sleeve such that the second flap is configured to act as a sail, being permanently attached to the second sleeve along a longitudinal direction of the second sleeve, and fixedly attached or adapted to attach to, and extending along the torso portion in a direction from where the second sleeve extends from the torso portion toward the lower end of the torso portion without extending past the lower end of the torso portion, wherein:

the first flap is adapted to separate from the torso portion, or the first flap defines a corner at a junction between the torso portion and the first sleeve and an outer edge opposite to the corner, and the first flap is adapted to separate along a line extending from the outer edge toward the corner, wherein the first sleeve is adapted to entirely cover an arm of the wearer along a length of the first sleeve, and wherein the first flap extends along the first sleeve in a direction from a proximal end of the first sleeve where the first sleeve extends from the torso portion toward a distal end of the first sleeve, and past an elbow portion of the first sleeve that is configured to cover an elbow of the wearer.

22. The garment of claim 21, further comprising a leg portion extending from a lower region of the torso portion and adapted to cover at least a portion of a wearer's legs.

* * * * *